US007597110B2

(12) United States Patent
Ertle

(10) Patent No.: US 7,597,110 B2
(45) Date of Patent: Oct. 6, 2009

(54) WATER-BEARING DOMESTIC APPLIANCE COMPRISING A DRAINAGE PUMP AND CORRESPONDING DRAINAGE PUMP

(75) Inventor: Roland Ertle, Lauingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 577 days.

(21) Appl. No.: 10/539,499

(22) PCT Filed: Nov. 26, 2003

(86) PCT No.: PCT/EP03/13317

§ 371 (c)(1),
(2), (4) Date: Jun. 17, 2005

(87) PCT Pub. No.: WO2004/055373

PCT Pub. Date: Jul. 1, 2004

(65) Prior Publication Data

US 2006/0147327 A1 Jul. 6, 2006

(30) Foreign Application Priority Data

Dec. 18, 2002 (DE) ..... 102 59 347
Apr. 25, 2003 (DE) ..... 103 18 862

(51) Int. Cl.
*B08B 3/04* (2006.01)

(52) U.S. Cl. ..... 134/184; 134/186

(58) Field of Classification Search ..... 134/184, 134/186; 415/182.1
See application file for complete search history.

(56) References Cited

U.S. PATENT DOCUMENTS 2,306,951 A * 12/1942 Jennings ..... 415/128
2,680,409 A * 6/1954 Sebens ..... 415/205
3,018,650 A * 1/1962 Schmidt ..... 68/23.4
3,702,680 A * 11/1972 Woehler ..... 239/256
3,707,334 A * 12/1972 Ohlsson et al. ..... 415/121.3
4,743,161 A * 5/1988 Fisher et al. ..... 415/58.4
5,257,901 A * 11/1993 Malchow ..... 415/182.1

FOREIGN PATENT DOCUMENTS

DE 25 05 329 * 8/1978
DE 34 12 774 10/1985
FR 1.130.511 2/1957

(Continued)

OTHER PUBLICATIONS

International Search Report for PCT/EP2003/013317, Apr. 2004.

*Primary Examiner*—Frankie L Stinson
(74) *Attorney, Agent, or Firm*—James E. Howard

(57) ABSTRACT

A water-bearing domestic appliance includes a retainer for retaining items to be subjected to a liquid treatment and a drainage pump having an inlet through which liquid enters the drainage pump. The drainage pump also includes an outlet through which liquid exits the drainage pump, a pump impeller for conveying liquid along a passage through the drainage pump extending from the inlet to the outlet, and a separate chamber located upstream of the pump impeller relative to the direction of flow of liquid through the passage. The separate chamber has an internal diameter and an external diameter and has respective radial bores on its external diameter and in the vicinity of its internal diameter.

14 Claims, 2 Drawing Sheets

FOREIGN PATENT DOCUMENTS

| | | | |
|---|---|---|---|
| FR | 1.594.848 | | 6/1970 |
| JP | 10-030586 | * | 2/1998 |
| JP | 2000-14964 | * | 1/2000 |
| JP | 2000-51135 | * | 2/2000 |
| JP | 2001-73890 | * | 3/2001 |

* cited by examiner

WATER-BEARING DOMESTIC APPLIANCE COMPRISING A DRAINAGE PUMP AND CORRESPONDING DRAINAGE PUMP

The invention relates to a water-bearing domestic appliance comprising a drainage pump which has a pump impeller used to convey liquid and to a drainage pump with a pump impeller.

In water-bearing domestic appliances such as dishwashers or washing machines a drainage pump is used to pump away dirty cleaning liquid. At the end of a drainage process air enters into the pump housing. This sucked-in air is concentrated at the centre of the rotating pump impeller as a result of the pressure conditions and results in a breakaway or reduced conveying flow. Any remaining quantities of liquid are thus not pumped away by the drainage pump or are pumped away with a delay. Every drainage pump shows this problem which results in operating disturbances or requires other expensive or disadvantageous measures.

A ventilation device for a drainage pump in dishwashers is known from the German Utility Model 94 06 463 U1, which has a ventilation opening on the suction side for air enclosed at the centre of the drainage pump to flow out. This ensures that functional disturbances on restarting the drainage pump are avoided.

It is the object of the invention to provide a water-bearing domestic appliance of the type described wherein the conveyance of air and liquid and the pumping capacity of the drainage pump are improved and further to provide a corresponding drainage pump.

The object is solved according to the invention for the water-bearing domestic appliance by the features of claim 1 and by the further independent claim for the drainage pump. Further developments of the invention are given in the dependent claims.

Starting from a water-bearing domestic appliance with a drainage pump which has a pump impeller and a drainage pump with a pump impeller, the draining pump according to the subject matter of the invention has a separate chamber which is located behind the pump impeller in relation to the direction of flow of liquid and is equipped with respective radial bores on its external diameter and in the vicinity of its internal diameter. As a result of the separate chamber, a liquid flow is advantageously formed from the external diameter to the internal diameter and then into the centre of the pump impeller whereby the air is better vortexed with the liquid and the mixture thus formed is more effectively pumped away. The pumping capacity and the suction behaviour of the drainage pump are improved, especially without external expenditure and without delaying of the conveying medium caused by ventilation openings or ventilation channels in the pump housing.

According to a favourable further development of the invention, the separate chamber is arranged as close as possible to the pump impeller. The liquid flow in the flow circuit of the drainage pump from the external diameter to the internal diameter of the separate chamber and from there to the centre of the pump impeller for mixing liquid with air can thus be further improved.

According to a further favourable embodiment of the invention, a plurality of bores are provided for the external diameter and the internal diameter. The bores for the external diameter and internal diameter are preferably provided so that they are each distributed uniformly on the separate chamber. Both measures positively influence the liquid flow in relation to the flow circuit of the drainage pump.

A further embodiment of the invention whereby the bores have a small cross-section has proved to be of particular value.

The previously described features are advantageously also used in the drainage pump with an impeller according to the invention and especially in dishwashers and washing machines.

The invention provides a water-bearing domestic appliance with a drainage pump which has a pump impeller used to convey liquid, wherein the conveyance of air and liquid and the pump capacity of the drainage pump are improved and further provides a corresponding drainage pump with a pump impeller.

The subject matter of the invention is explained in detail with reference to an exemplary embodiment shown in the figures. In detail the figures show:

Figure 1:
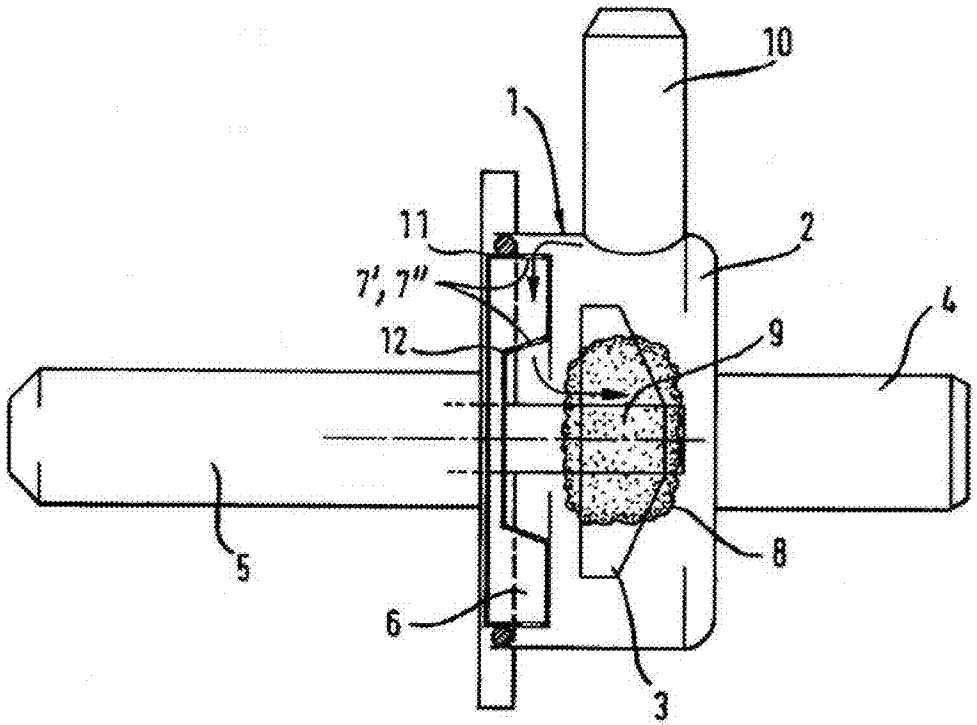
FIG. 1 shows a drainage pump 1 according to the invention of a water-bearing domestic appliance according to the invention.
Figure 3:
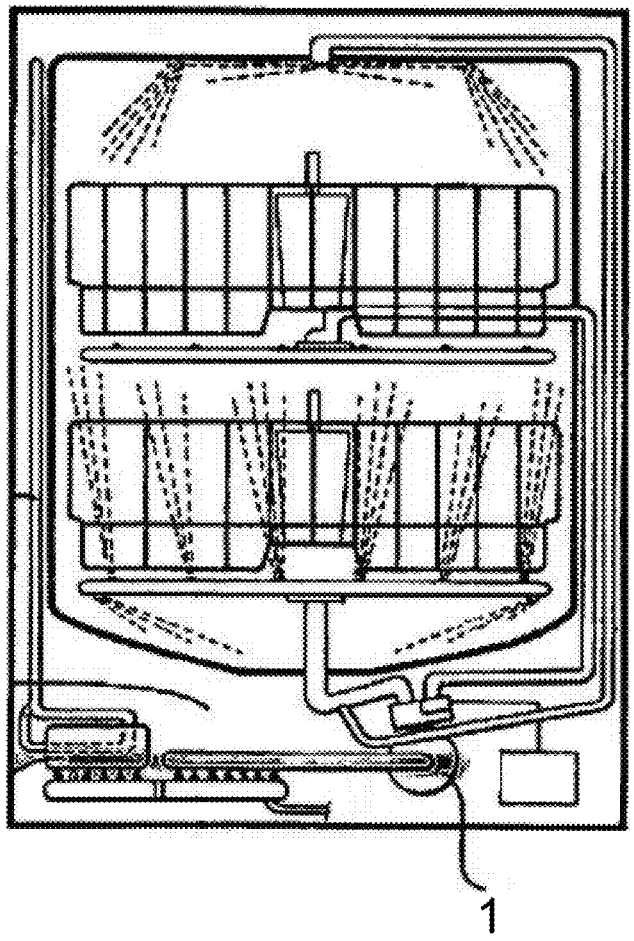
FIG. 3 shows the water-bearing domestic appliance according to the invention and showing a retainer thereof for retaining items to be subjected to a liquid treatment.

FIG. 1 shows a drainage pump 1 of a water-bearing domestic appliance according to the invention, the water-bearing domestic appliance typically being a dishwasher or a washing machine and being representatively shown in FIG. 3 as a dishwasher. The water-bearing appliance has a pump housing 2 with a pump impeller 3. An inlet connecting piece 4 via which liquid, for example water, can be conveyed into the pump impeller 3 or air can be sucked in, runs in the direction of the axis of the pump impeller 3 and is moulded on the input side of the pump housing 2. A motor housing 5 with the drive motor for the pump impeller 3 for example with straight vanes which can be set in rotation is also located in the direction of the axis of the pump impeller 3 and is moulded on the other side of the pump housing 2. The drainage pump 1 also has an outlet connecting piece 10 which is arranged radially in relation to the axis of the pump impeller 3.

According to the subject matter of the invention, the water-bearing domestic appliance has a drainage pump 1 with a separate chamber 6 which is located behind the pump impeller 3 in relation to the direction of the conveyed liquid, i.e., the axis of the pump impeller 3, and is provided with respective radial bores 7' and 7" on its external diameter 11 and in the vicinity of its internal diameter 12. As a result of the separate chamber 6, a liquid flow, identifiable from the arrows in FIG. 1, is advantageously produced from the external diameter 11 to the internal diameter 12 and then into the centre 9 of the pump impeller 3, whereby the air is better vortexed with the liquid and the mixture 8 thus produced is pumped away more effectively. The pump capacity and the suction behaviour of the drainage pump 1 are improved, especially without external expenditure and without any delay of the conveying medium caused by ventilation openings or ventilation channels in the pump housing 2.

In a favourable fashion the separate chamber 6 is arranged as close as possible to the pump impeller 3 whereby the liquid flow in the flow circuit—see arrows—of the drainage pump 1 from the external diameter 11 to the internal diameter 12 of the separate chamber 6 and from there to the centre 9 of the pump impeller 3 for mixing liquid with air can thus be further improved. A plurality of bores 7', 7" are provided for the external diameter 11 and the internal diameter 12 and preferably provided so that they are each distributed uniformly on the separate chamber 6. Both measures positively influence the liquid flow—see arrows—in relation to the flow circuit of the drainage pump 1.

Figure 2:
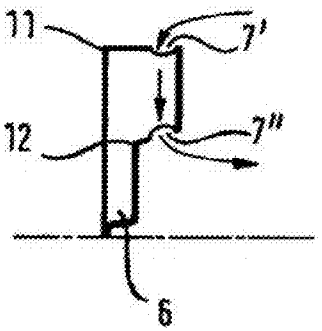
FIG. 2 shows a section of the chamber pertaining to the drainage pump with an exemplary arrangement of bores.

For illustration FIG. 2 shows a section of the separate chamber 6 pertaining to the drainage pump with an exemplary arrangement of bores. Thus, one bore 7' is located on the external diameter 11 of the chamber 6 whereas another bore 7" is located near the internal diameter 12 of the chamber 6. In total, the chamber 6 has respectively four uniformly distributed radial bores 7' and 7" both on its external diameter 11 and also on its internal diameter 12. The arrows show the behaviour of the liquid flow from the external diameter 11 with bore 7' where a higher pressure prevails to the internal diameter 12 with bore 7" where a lower pressure prevails and from there to the centre of the pump impeller. It has proved to be of particular value if the bores have a small cross-section so that all the bores have a diameter of 3.5 mm each for example.

The invention provides a water-bearing domestic appliance with a drainage pump 1 which has an impeller wheel 3 used to convey liquid, wherein the conveyance of air and liquid and the pump capacity of the drainage pump 1 are improved and further provides a corresponding drainage pump 1 with a pump impeller 3.

The invention claimed is:

1. A water-bearing domestic appliance comprising:

a retainer for retaining items to be subjected to a liquid treatment: and a drainage pump having an inlet through which liquid enters the drainage pump, an outlet through which liquid exits the drainage pump, a pump impeller for conveying liquid along a passage through the drainage pump extending from the inlet to the outlet, and a separate chamber located downstream of the pump impeller relative to the direction of flow of liquid through the passage, the separate chamber having an internal diameter and an external diameter and having respective radial bores on its external diameter and in the vicinity of its internal diameter, and the operation of the drainage pump being such that liquid received into the drainage pump via the inlet flows into an area of the passage at which the pump impeller is operating and thereafter flows further along the passage with at least some of the liquid flowing into contact with the separate chamber downstream of the pump impeller and entering and passing through the radial bores of the separate chamber.

2. The water-bearing domestic appliance according to claim 1, wherein the separate chamber is located relatively closely adjacent the pump impeller.

3. The water-bearing domestic appliance according to claim 1, wherein a respective plurality of bores are provided on the external diameter of the separate chamber and another respective plurality of bores are provided on the internal diameter of the separate chamber.

4. The water-bearing domestic appliance according to claim 1, wherein the bores for the external diameter and the internal diameter are distributed uniformly on the separate chamber.

5. The water-bearing domestic appliance according to claim 1, wherein each of the bores has a small cross-section.

6. The water-bearing domestic appliance according to claim 1, wherein the water-bearing domestic appliance is a dishwasher and the retainer for retaining items to be subjected to a liquid treatment is operable to retain items to subjected to a dishwasher liquid treatment.

7. The water-bearing domestic appliance according to claim 1, wherein the water-bearing domestic appliance is a washing machine and the retainer for retaining items to be subjected to a liquid treatment is operable to retain items to subjected to a washing machine liquid treatment.

8. A drainage pump comprising:

an inlet through which liquid enters the drainage pump;

an outlet through which liquid exits the drainage pump;

a pump impeller for conveying liquid along a passage through the drainage pump extending from the inlet to the outlet; and a separate chamber located downstream of the pump impeller relative to the direction of flow of liquid through the passage, the separate chamber having an internal diameter and an external diameter and having respective radial bores on its external diameter and in the vicinity of its internal diameter, and the operation of the drainage pump being such that liquid received into the drainage pump via the inlet flows into an area of the passage at which the pump impeller is operating and thereafter flows further along the passage with at least some of the liquid flowing into contact with the separate chamber downstream of the pump impeller and entering and passing through the radial bores of the separate chamber.

9. The drainage pump according to claim 8, wherein the separate chamber is located relatively closely adjacent the pump impeller.

10. The drainage pump according to claim 8, wherein a respective plurality of bores are provided on the external diameter of the separate chamber and another respective plurality of bores are provided on the internal diameter of the separate chamber.

11. The drainage pump according to claim 8, wherein the bores for the external diameter and the internal diameter are distributed uniformly on the separate chamber.

12. The drainage pump according to claim 8, wherein each of the bores has a small cross-section.

13. The drainage pump according to claim 8, wherein the drainage pump is operable in a water-bearing domestic appliance in the form of a dishwasher.

14. The drainage pump according to claim 8, wherein the drainage pump is operable in a water-bearing domestic appliance in the form of a washing machine.

* * * * *

UNITED STATES PATENT AND TRADEMARK OFFICE

CERTIFICATE OF CORRECTION

PATENT NO. : 7,597,110 B2
APPLICATION NO. : 10/539499
DATED : October 6, 2009
INVENTOR(S) : Roland Ertle It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 975 days.

Signed and Sealed this

Twenty-eighth Day of September, 2010

David J. Kappos

David J. Kappos
*Director of the United States Patent and Trademark Office*